United States Patent [19]

Ariga et al.

[11] 3,982,314

[45] Sept. 28, 1976

[54] METHOD OF PRODUCING TIN COATED STEEL SHEET USED FOR SEAMLESS STEEL CONTAINER

[75] Inventors: Keiji Ariga; Tadashi Nemoto; Kenji Yasunaka, all of Kudamatsu, Japan

[73] Assignee: Kozo Yoshizaki, Tokyo, Japan

[22] Filed: July 9, 1975

[21] Appl. No.: 594,196

Related U.S. Application Data

[63] Continuation of Ser. No. 415,018, Nov. 12, 1975, abandoned.

[30] Foreign Application Priority Data

Nov. 14, 1972 Japan ..... 47-113548
Feb. 12, 1973 Japan ..... 48-16436

[52] U.S. Cl. ..... 29/527.4; 113/120 A; 204/37 T; 204/38 B; 204/38 S; 220/64; 29/196.3; 29/196.4; 29/196.6

[51] Int. Cl.[2] ..... B22D 11/126

[58] Field of Search ..... 29/527.4, 196.6, 196.4, 29/196.3, 527.2, DIG. 12, 599; 427/405; 204/37 T, 38 S, 38 B; 113/120 A, 120 H; 220/64

[56] References Cited

UNITED STATES PATENTS

| | | | |
|---|---|---|---|
| 1,517,910 | 12/1924 | Kirschner | 204/37 T |
| 1,898,739 | 2/1933 | Meyer | 29/527.4 X |
| 2,266,330 | 12/1941 | Nachtman | 204/23 |
| 2,428,033 | 9/1947 | Nachtman | 204/37 |
| 2,738,897 | 3/1956 | Russell et al. | 204/37 T |
| 2,797,476 | 7/1957 | Sendzimir | 29/527.4 |
| 2,839,437 | 6/1958 | Manko | 204/37 T |
| 2,876,176 | 3/1959 | Pearson et al. | 204/37 T |
| 3,481,715 | 12/1969 | Whalen et al. | 427/405 |
| 3,498,823 | 3/1970 | Jones | 117/71 |

FOREIGN PATENTS OR APPLICATIONS

| | | | |
|---|---|---|---|
| 362,608 | 12/1931 | United Kingdom | 204/38 B |

*Primary Examiner*—C.W. Lanham
*Assistant Examiner*—V. Rising
*Attorney, Agent, or Firm*—George B. Oujevolk

[57] ABSTRACT

Tin coated steel sheet used for seamless steel containers by applying of a coating at least one material selected from the group consisting of nickel, cobalt, copper, nickel oxide, cobalt oxide, copper oxide, tin oxide, copper-tin compound, cobalt-copper compound, cobalt-copper compound, cobalt-nickel compound, nickel-copper compound, cobalt-tin compound, nickel-tin compound and nickel-sulfur compound, onto one or both of the surface of cold rolled and cleaned steel strip or sheet. The coated steel strip or sheet is then coated with tin, and the tin coating may then be flow-melted subsequently.

3 Claims, No Drawings

METHOD OF PRODUCING TIN COATED STEEL SHEET USED FOR SEAMLESS STEEL CONTAINER

This is a continuation of application Ser. No. 415,018 filed Nov. 12, 1975, now abandoned.

BACKGROUND OF THE INVENTION

This invention relates to a method of tin coated steel sheet having excellent formability in the production of seamless steel containers by drawing and ironing operation.

Many processes are presently being utilized for forming seamless containrs from flat blanks. One of these procedures involves first drawing the blank into cup form by forcing the blank through a drawing die by means of a punch mounted upon a press. After drawing, the cup is passed through one or more ironing dies whose inside diameters are progressively smaller than the outside diameters of the cup.

As described in U.S. Pat. No. 3,360,157, "ironing" may be defined as thinning the walls of a deep-drawn article by reducing the clealance between punch and die.

In the ironing operation the side wall of the cup is elongated by reducing its thickness without reducing the inside diameter of the cup.

It is generally accomplished by forcing the cup and the punch through an ironing die whose diamerer is slightly less than the outer diameter of the cup and producing a longer seamless cup-shaped container with thinner side wall.

While the drawing and ironing process has been used in the manufacturing of seamless aluminum containers, tin coated steel sheet has also come into use as the material for seamless container, because the presence of surface tin coating enables a greater extent of deformation to steel sheet in the drawing and ironing operation.

A commercial tin coated steel sheet is made by continuous electrolytic plating of tin onto the steel, then the tin coating is normally melted and flow-brightened subsequently.

This commercial flow-melted tin coated steel sheet is found to need slightly greater force in the ironing operation than the non-flow-brightened tin coated steel sheet. However, the force needed is still much lower than the case of not-tinned plain steel.

As described in U.S. Pat. No. 3,360,157, the matte tin coated steel sheet that is produced without flow-brightened is more suitable to produce seamless containers by drawing and ironing, so that the matte tin coated steel sheet is used for this purpose.

However, the matte tin coated steel sheet has still room for improvement to accomplish the drawing and ironing easily without any fracture of the steel.

On the basis of such knowledge as described above, this invention provides a method for obtaining a tin coated steel sheet having excellent formability in the production of the seamless steel containers by forming an intermediate layer between steel and tin coatings.

SUMMARY OF THE INVENTION:

An object of the present invention is to provide a method of producing tin coated steel sheet having excellent formability in the production of seamless steel containers.

Another object is to provide a method of producing tin coated steel sheet fitted to be worked without fracture into seamless steel containers having an end thickness equal to the thickness of the original blank and a side wall thickness substantially less than the thickness of the original blank.

An additional object of the present invention is to provide a method of producing tin coated steel sheet which can be ironed with higher reduction ratio and can be formed into a seamless steel container having thinner side wall thickness than that from commercial tin coated steel sheet.

Briefly, the foregoing objects are accomplished in accordance with aspect of this invention by following features:

1. At least one material selected from the group consisting of nickel, cobalt, copper, nickel oxide, cobalt oxide, copper oxide, tin oxide, nickel-tin compound, cobalt-tin compound, copper-tin compound, copper-nickel compound, nickel-cobalt compound, copper-cobalt compound and nickel-sulfer compound is applied onto one or both of the surface of steel sheet previously subjected to surface-cleaning treatment and coated with tin.

2. At least one material selected from the group consisting of nickel, cobalt, copper, nickel oxide, cobalt oxide, copper oxide, tin oxide, nickel-tin compound, cobalt-tin compound, copper-tin compound, copper-nickel compound, nickel-cobalt compound, copper-cobalt compound and nickel-sulfur compound is applid onto one or both of the surface of steel sheet previously subjected to surface-cleaning treatment and coated with tin by normal electroplating followed by flow-melting.

DETAILED DESCRIPTION:

According to the present invention, a cold rolled steel sheet is precoated first with at least one material selected from the group consisting of nickel, cobalt, copper, nickel oxide, cobalt oxide, copper oxide, tin oxide, copper-tin compound, cobalt-copper compound, cobalt-nickel compound, nickel-copper compound, cobalt-tin compound, nickel-tin compound and nickel-sulfer compound and then coated with tin at the same weight as the coating of conventional tin coated steel sheet which is not flow-melted or flow-melted subsequently after tin coating.

Said precoated coating materials have enough ductility and high lubricity.

It is found that these materials form some compound of these materials and tin easily without formation of iron-tin alloy during flow-melting, and the compound of these materials and tin may become solid lubricant, in which the typical coating materials are such metals as copper and nickel.

The other coating materials may also be changed into solid lubricant by flow-melting, so the formation of alloy of steel and tin is suppressed. In this case the typical coating materials are cobalt oxide and nickel oxide.

The steel sheet used for seamless steel containers should be deposited with at least one materials described above onto one or both surfaces of the cold-rolled and cleaned steel sheet to the weight of from 0.01 to 5.0 g/m$^2$ by a method selected from the group of electroplating, vacuum coating, electrophoretic coating, chemical plating, vapor plating, hot-dipped coating, roll coating and spray coating.

To suppress the alloying of base steel and tin during flow-melting, the coating weight of these materials should be over 0.01 g/m². While, to obtain excellent formability in the drawing and ironing operation, the coating of these materials should not exceed 5 g/m².

The coating may form a intermediate layer between the base steel and tin during the tinning and flow-melting, which must become excellent lubricant.

For the purpose of giving those skilled in the art a better understanding of an invention, the following illustrative examples are given.

EXAMPLE 1

The compositions and mechanical properties of the cold rolled steel sheet which is used are indicated in Table I.

Table 1

| The composition of the steel (percent by weight) | |
|---|---|
| C | 0.03 |
| Mn | 0.32 |
| S | 0.014 |
| P | 0.014 |
| Si | 0.01 |
| Cu | 0.023 |

The mechanical properties of the steel

| | |
|---|---|
| Ultimate tensile strength | 31.5 Kg/mm² |
| Yield strength | 24.5 Kg/mm² |
| Elongation | 35.3 % |
| Hardness | 53 HRC 30 T |

The steel sheet thickness of 0.32 mm was electrolytically degreased in 7 % sodium hydroxide solution and rinsed with water, then pickled in 7 % sulfuric acid and rinsed again with water.

The sheet then was coated with copper to the weight of 0.9 g/m² in aqueous electrolyte containing copper pyrophosphate 190 g/l, potassium pyrophosphate 340 g/l and potassium oxalate 10 g/l.

After water rinse, the sheet is coated with tin in conventional acidic electrolyte to the weight of 11.2 g/m², and then electro-chemically treated in sodium dichromate solution.

The tin coated steel sheet was cut into a circular blank having diameter of 141 mm by means of a punch press.

The flat circular blank was drawn through a cupping die by means of a drawing punch of 65.5 mm diameter.

After drawing, the cup was passed through three ironing dies. The clearance between the final ironing die and the punch was designed to result the final side wall thickness of 0.085 mm.

The results are shown in Table 2. The last column in the table shows fracture percent in the above described ironing operation.

EXAMPLE 2

A steel sheet of the same type as used in example 1 was precoated with copper in electrolyte as used in example 1 to the weight of 0.9 g/m².

After water rinse, the steel sheet was coated with tin in conventional acidic electrolyte to the weight of 11.2 g/m², then flow-melted and finally electrochemically treated.

The tin coated steel sheet was tested by the drawing and ironing process as described in example Y.

EXAMPLE 3

A steel sheet of the same type as used in example 1 was precoated with copper in the same electrolyte as used in example 1 to the weight of 5 g/m².

After water rinse, the steel sheet was coated with tin in conventional acidic electrolyte to the weight of 11.2 g/m², then flow-melted and finally electrochemically treated.

The tin coated steel was tested by the drawing and ironing process as described in example 1.

EXAMPLE 4

A test sample was made in the same manner as in example 1, with one exception of changing precoating material before tin coating.

Copper oxide was precoated in the electrolyte containing copper sulfate 1 g/l, manganese sulfate 70 g/l and ammonium sulfate 40 g/l to the weight of 0.2 g/m².

The obtained deposit compositions were mainly copper oxide including a trace amount if metallic copper and a small amount of manganese. It is probable that the copper oxide formed cathodic electrolysis is hydrated oxide including metallic copper and manganese.

After precoating, the steel sheet was coated with tin in a conventional acidic electrolyte to a weight of 11.2 g/m², then flow-melted.

The tin coated steel sheet was tested by the drawing and ironing process as described example 1.

EXAMPLE 5

The steel sheet of the same type as used in example 1 was coated with copper in an electrolyte containing copper pyrophosphate 190 g/l, potassium pyrophosphate 340 g/l and 28 % ammonia water 3 cc/l to the weight of 0.7 g/m², and then successively coated with copper oxide including a small amount of manganese in an electrolyte containing copper sulfate 2 g/l, manganese sulfate 70 g/l and ammonium sulfate 30 g/l to the weight of 0.2 g/m², and then coated with tin in a conventional acidic electrolyte to the weight of 11.2 g/m², then finally flow-melted.

The tin coated steel sheet was tested by drawing and ironing as described in example 1.

EXAMPLE 6

The steel sheet of the same type as used in example 1 was coated with nickel oxide in the electrolyte containing nickel sulfate 50 g/l, manganese sulfate 100 g/l and ammonium sulfate 75 g/l to the weight of 0.3 g/m² on the surface of the steel sheet.

The compositions of obtained deposit were mainly nickel oxide including a trace amount of metallic nickel and a small amount of manganese. It is probable that the nickel oxide formed by cathodic electrolysis is hydrated oxide including metallic nickel and manganese.

After precoating, the steel sheet was coated with tin in conventional alkaline electrolyte to the weight of 11.2 g/m², then flow-melted.

The tin coated steel sheet was tested by the drawing and ironing process as described example 1.

EXAMPLE 7

The steel sheet of the same type as used in example 1 was coated with nickel in an electrolyte containing nickel sulfate 150 g/l, nickel chloride 15 g/l, and boric acid 15 g/l to the weight of 0.01 g/m², and then cobalt oxide was successively coated by cathodic electrolysis in an electrolyte containing cobalt sulfate 10 g/l, manganese sulfate 60 g/l and ammonium sulfate 50 g/l to the weight of 0.2 g/m².

The deposited cobalt oxide may be hydrated oxide including a trace amount of metallic cobalt.

And then, the steel sheet was coated with tin to the weight of 11.2 g/m² in conventional alkaline electrolyte, then flow-melted.

The tin coated steel sheet was tested by the drawing and ironing process as described example 1.

EXAMPLE 8

The steel sheet of the same type as used in example 1 was coated with cobalt oxide by cathodically electrolysis in a electrolyte containing cobalt sulfate 20 g/l, manganese sulfate 70 g/l and ammonium sulfate 50 g/l to the weight of 0.5 g/m². The deposition may be hydrated oxide including a trace amount of metallic cobalt.

Then, tin was coated in the conventional acidic electrolyte to the weight of 11.2 g/m², and then flow-melted.

The tin coated steel sheet was tested by the drawing and ironing process as described in example 1.

EXAMPLE 9

The steel sheet of the same type as used in example 1 was coated with cobalt in a electrolyte containing cobalt sulfate 40 g/l, ammonium sulfate 50 g/l and manganese sulfate 70 g/l at a current density of 0.1 A/dm² to the weight of 0.1 g/m², and successively coated with cobalt oxide in the same electrolyte by cathodically electrolysis at a current density of 25 A/dm² to the weight of 0.2 g/m² onto the surface coated steel sheet.

And then, tin was coated in acidic electrolyte to the weight 11.2 g/m², and then flow-melted.

The tin coated steel sheet was tested by the drawing and ironing process as described in example 1.

EXAMPLE 10

The same cold-rolled steel sheet as in example 1 was coated with cobalt oxide including a trace amount of manganese and aluminum in a electrolyte containing cobalt sulfate 10 g/l, manganese sulfate 75 g/l, aluminum sulfate 10 g/l and ammonium sulate 60 g/l by cathodic electrolysis to the weight of 0.3 g/m². Then, tin was coated in conventional acidic electrolyte to the weight of 11.2 g/m², and then flow-melted.

The tin coated steel sheet was tested by the drawing and ironing process as described in example 1.

EXAMPLE 11

The steel sheet of the same type as used in example 1 was coated with cobalt in electrolyte containing cobalt sulfate 250 g/l, ammonium chloride 20 g/l and boric acid 50 g/l to the weight of 1.2 g/m². And then, tin was coated in conventional acidic electrolyte to the weight of 11.2 g/m², and flow-melted.

The tin coated steel sheet was tested by the drawing and ironing process as described in example 1.

EXAMPLE 12

The same cold-rolled steel sheet as in example 1 was coated with tin oxide in a electrolyte containing tin sulfate 2 g/l, manganese sulfate 50 g/l and ammonium sulfate 40 g/l by cathodic electrolysis at a current density of 50 A/dm² to the weight of 1.0 g/m². Then, tin was coated in conventional acidic electrolysis to the weight of 11.2 g/m². The tin coated steel sheet was tested by the drawing and ironing process as described in example 1.

EXAMPLE 13

The steel sheet of the same type as used in example 1 was coated with nickel including sulfur in an electrolyte containing nickel ammonium sulfate 100 g/l, sodium citrate 15 g/l and sodium thiosulfate 10 g/l to the weight of 0.2 g/m², and coated with tin in conventional acidic electrolyte to the weight of 5.6 g/m², then flow-melted.

The tin coated steel sheet was tested by the drawing and ironing process as described in example 1.

EXAMPLE 14

The steel sheet of the same type as used in example 1 was coated with nickel including sulfur in an electrolyte containing nickel ammonium sulfate 100 g/l, sodium citrate 15 g/l and sodium thiosulfate 10 g/l to the weight of 0.2 g/m², and coated with tin in conventional acidic electrolyte to the weight of 5.6 g/m².

The tin coated steel sheet was tested by the drawing and ironing process as described in example 1.

As described in table 2, the tin coated steel sheet by the method of this invention provides excellent formability in ironing than conventional flow-melted tin coated steel sheet and tin coated steel sheet of matte finish described in U.S. Pat. No. 3,360,157.

It is apparent that many modification could be made in the above described inventive process without departing from the basic concept. For example, it is obvious that other techniques could be employed for applying the precoated materials and tin coating onto the steel sheet.

In addition, for precoating materials, such soft and lubricant materials as silver, phosphorous, graphite and these compounds are used and retain substantially the same formability characteristics in drawing and ironing operation. Furthermore it is apparent that various change may be made in the step of the process described without departing from the spirit and scope of the invention. For example, the above-described precoating process could be applied before annealing, and could be annealed and then tin coated.

Table 2

| Example No. | Procoating materials | Pro-coating weight (g/m²) | Tin coating weight (g/m²) | Flow-melt | Fracture percent |
|---|---|---|---|---|---|
| 1 | copper | 0.9 | 11.2 | non | 14 |
| 2 | " | " | " | flowmelted | 20 |
| 3 | " | 5.0 | " | " | 20 |
| 4 | copper oxide | 0.2 | " | " | 0 |
| 5 | copper | 0.7 | " | " | 0 |
| | copper-oxide | 0.2 | | | |
| 6 | nickel oxide | 0.3 | " | " | 20 |
| 7 | nickel | 0.01 | " | " | 20 |
| | cobalt-oxide | 0.2 | | | |
| 8 | cobalt oxide | 0.5 | " | " | 0 |
| 9 | cobalt | 0.1 | " | " | 0 |
| | cobalt-oxide | 0.2 | | | |
| 10 | cobalt oxide | 0.3 | " | " | 0 |
| 11 | cobalt | 1.2 | " | " | 30 |
| 12 | tin oxide | 1.0 | " | " | 24 |
| 13 | nickel & sulfur | 0.2 | 5.6 | " | 0 |
| 14 | nickel & sulfur | 0.2 | 5.6 | non | 30 |

Table 2-continued

| Example No. | Procoating materials | Procoating weight ($g/m^2$) | Tin coating weight ($g/m^2$) | Flow-melt | Fracture percent |
|---|---|---|---|---|---|
| | Conventional | | | | |
| | Flow-melted | 11.2 | flow-melted | | 100 |
| | Matte | 11.2 | non | | 50 |

We claim:

1. A method of producing a tin coated steel substrate used for seamless steel containers comprising coating said steel substrate with 0.01 to 5 $g/m^2$ by weight of at least one compound selected from the group consisting of nickel oxide, cobalt oxide, copper oxide, tin oxide and a nickel-sulfur compound to form an intermediate layer, and then electroplating tin on said intermediate layer to form said tin coated steel substrate.

2. The method of claim 1 and further comprising the step of flow-melting the tin which is electroplated on said intermediate layer.

3. The method of claim 1 and further comprising drawing and ironing said tin coated steel substrate to form said seamless steel container.

* * * * *